US011398190B2

(12) United States Patent
Shen et al.

(10) Patent No.: US 11,398,190 B2
(45) Date of Patent: Jul. 26, 2022

(54) DISPLAY DRIVING DEVICE HAVING DELAYED LIGHT-EMISSION CONTROL SIGNALS AND DRIVING METHOD THEREOF

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Lixia Shen, Beijing (CN); Yong Yu, Beijing (CN); Zhiguang Zhang, Beijing (CN); Taehyun Kim, Beijing (CN); Chang Zhang, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 607 days.

(21) Appl. No.: 16/340,598

(22) PCT Filed: Aug. 30, 2018

(86) PCT No.: PCT/CN2018/103143
§ 371 (c)(1),
(2) Date: Apr. 9, 2019

(87) PCT Pub. No.: WO2019/076143
PCT Pub. Date: Apr. 25, 2019

(65) Prior Publication Data

US 2021/0358419 A1 Nov. 18, 2021

(30) Foreign Application Priority Data

Oct. 16, 2017 (CN) ..... 201710961531.0

(51) Int. Cl.
*G09G 3/3275* (2016.01)
*G09G 3/3225* (2016.01)

(52) U.S. Cl.
CPC ..... *G09G 3/3275* (2013.01); *G09G 3/3225* (2013.01); *G09G 2310/0272* (2013.01)

(58) Field of Classification Search
CPC ..... G09G 3/3275
(Continued)

(56) References Cited

U.S. PATENT DOCUMENTS

2005/0253791 A1 11/2005 Shin
2006/0244387 A1* 11/2006 Park ..... G09G 3/3233 315/169.1

(Continued)

FOREIGN PATENT DOCUMENTS

CN 1490781 A 4/2004
CN 1697008 A 11/2005

(Continued)

OTHER PUBLICATIONS

First Office Action for Chinese Application No. 201710961531.0, dated Mar. 11, 2019, 8 Pages.

(Continued)

*Primary Examiner* — Long D Pham
(74) *Attorney, Agent, or Firm* — Brooks Kushman P.C.

(57) ABSTRACT

A display driving method, a display driving device and a display module are provided. The display driving method includes: during each delay cycle, controlling a first light-emission control signal to be delayed by a predetermined duration from a second light-emission control signal, the predetermined duration corresponding to the delay cycle. The first light-emission control signal is a light-emission control signal outputted by each light-emission control line during an (n+1)-th frame of display time period in the delay (Continued)

cycle, and the second light-emission control signal is a light-emission control signal outputted by the corresponding light-emission control line during an n-th frame of display time period in the delay cycle. Each delay cycle includes N frames of display time periods, N is a positive integer greater than a first predetermined number, and n is a positive integer less than N.

18 Claims, 2 Drawing Sheets

(58) Field of Classification Search
USPC ..... 345/204
See application file for complete search history.

(56) References Cited

U.S. PATENT DOCUMENTS

| | | | |
|---|---|---|---|
| 2007/0018916 | A1 | 1/2007 | Kim et al. |
| 2007/0296672 | A1 | 12/2007 | Kim et al. |
| 2009/0206770 | A1 | 8/2009 | Hong et al. |
| 2009/0262051 | A1 | 10/2009 | Kim et al. |
| 2011/0001689 | A1 | 1/2011 | Maru et al. |
| 2012/0105390 | A1 | 5/2012 | Kim et al. |
| 2013/0215092 | A1 | 8/2013 | Wu et al. |
| 2016/0155381 | A1* | 6/2016 | Kwon ..... G09G 3/3233 345/215 |
| 2018/0114488 | A1 | 4/2018 | Jung |

FOREIGN PATENT DOCUMENTS

| | | | |
|---|---|---|---|
| CN | 1901766 | A | 1/2007 |
| CN | 101093639 | A | 12/2007 |
| CN | 101345022 | A | 1/2009 |
| CN | 102376254 | A | 3/2012 |
| CN | 102467872 | A | 5/2012 |
| CN | 102646389 | A | 8/2012 |
| CN | 102760410 | A | 10/2012 |
| CN | 104361878 | A | 2/2015 |
| CN | 105913816 | A | 8/2016 |
| CN | 107644613 | A | 1/2018 |
| CN | 107978272 | A | 5/2018 |

OTHER PUBLICATIONS

International Search Report and Written Opinion for Application No. PCT/CN2018/103143, dated Nov. 22, 2018, 10 Pages.

* cited by examiner

DISPLAY DRIVING DEVICE HAVING DELAYED LIGHT-EMISSION CONTROL SIGNALS AND DRIVING METHOD THEREOF

CROSS-REFERENCE TO RELATED APPLICATION APPLICATIONS

This application is the U.S. national phase of PCT Application No. PCT/CN2018/103143 filed on Aug. 30, 2018, which claims priority to Chinese Patent Application No. 201710961531.0 filed on Oct. 16, 2017, which are incorporated herein by reference in their entireties.

TECHNICAL FIELD

The present disclosure relates to the field of display driving technology, in particular to a display driving method, a display driving device and a display module.

BACKGROUND

At present, active matrix organic light-emitting diode (AMOLED) panels are widely used in displays of various electronic products or home appliances. Moreover, as the technology advances, users have increasingly high demands on the visual effects of display devices.

The pixel light-emitting element of the AMOLED is an organic light-emitting diode (OLED). The OLED is driven to emit light by a driving current that is generated by a driving transistor in a saturated state.

SUMMARY

A display driving method, a display driving device and a display module are provided according to the present disclosure.

A display driving method is provided according to the present disclosure, which is applied to a display module. The display module includes a plurality of light-emission control lines and a plurality of pixel circuits arranged in an array and corresponding to the plurality of light-emission control lines, and the pixel circuits in one row are connected to one of the light-emission control lines in the same row. A turn-on duration of the display module includes a plurality of delay cycles, and the display driving method including: during each of the delay cycles, controlling a first light-emission control signal to be delayed by a predetermined duration from a second light-emission control signal, the predetermined duration corresponding to the delay cycle, where the first light-emission control signal is a light-emission control signal outputted by each of the light-emission control lines during an (n+1)-th frame of display time period included in the delay cycle, and the second light-emission control signal is a light-emission control signal outputted by the corresponding light-emission control line during an n-th frame of display time period included in the delay cycle. Each of the delay cycles includes N frames of display time periods, N is a positive integer greater than a first predetermined number, and n is a positive integer less than N.

Optionally, the predetermined duration is M times as long as a turn-on duration of a row of gate line included in the display module, and M is a positive integer less than a second predetermined number.

Optionally, the display driving method further includes: controlling a light-emission control signal outputted by each of the light-emission control lines in the (a+1)-th delay cycle to be the same as a light-emission control signal outputted by the corresponding light-emission control line in the a-th delay cycle, a being a positive integer.

Optionally, the display driving method further includes: controlling the light-emission control signal outputted by each of the light-emission control lines to be a pulse width modulation signal during each frame of display time period.

Optionally, a preparation time period is provided between any adjacent frames of display time periods, and the display driving method further includes: controlling data lines included in the display module to output a direct-current voltage during the preparation period.

A display driving device is further provided according to the present disclosure, which is applied to a display module. The display module includes a plurality of light-emission control lines and a plurality of pixel circuits arranged in an array and corresponding to the plurality of light-emission control lines, and the pixel circuits in one row are connected to one of the light-emission control lines in the same row. A turn-on duration of the display module includes a plurality of delay cycles, and the display driving device including:

a light-emission control signal controlling circuit, connected to the plurality of light-emission control lines, and configured to control, during each of the delay cycles, a first light-emission control signal to be delayed by a predetermined duration from a second light-emission control signal, where the first light-emission control signal is a light-emission control signal outputted by each of the light-emission control lines during an (n+1)-th frame of display time period included in the delay cycle, and the second light-emission control signal is a light-emission control signal outputted by the corresponding light-emission control line during an n-th frame of display time period included in the delay cycle; and where each of the delay cycles includes N frames of display time periods, N is a positive integer greater than a first predetermined number, and n is a positive integer less than N.

Optionally, the predetermined duration is M times as long as a turn-on duration of a row of gate line included in the display module, and M is a positive integer less than a second predetermined number.

Optionally, the light-emission control signal controlling circuit is further configured to control a light-emission control signal outputted by each of the light-emission control lines in the (a+1)-th delay cycle to be the same as a light-emission control signal outputted by the corresponding light-emission control line in the a-th delay cycle, a being a positive integer.

Optionally, the light-emission control signal controlling circuit is further configured to control the light-emission control signal outputted by each of the light-emission control lines to be a pulse width modulation signal during each frame of display time period.

Optionally, a preparation period is provided between any adjacent frames of display time periods, and the display driving device further includes: a source electrode driving circuit, configured to control data lines included in the display module to output a direct-current voltage during the preparation period.

A display module is further provided according to the present disclosure, which includes the display driving device described above.

DETAILED DESCRIPTION

Hereinafter, technical solutions in embodiments of the disclosure are described clearly and completely in conjunction with drawings of the embodiments of the disclosure. It is apparent that the described embodiments are only a part rather than all of embodiments of the present disclosure. Other embodiments obtained by those skilled in the art on the basis of the embodiments of the present disclosure without creative work shall fall within the protection scope of the present disclosure.

Figure 1:
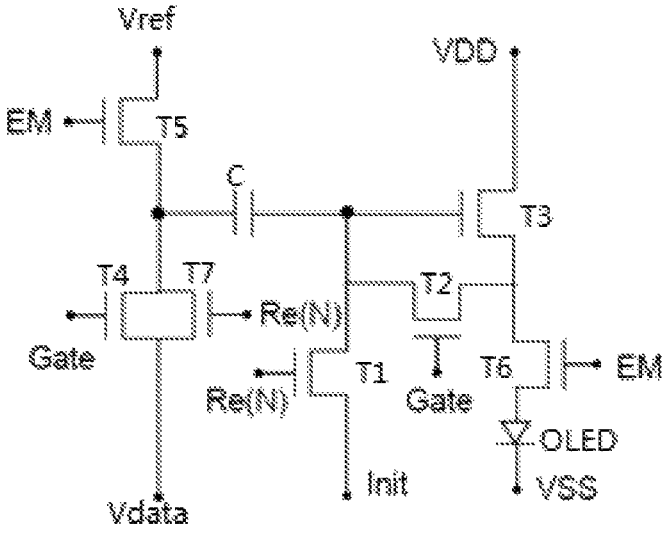
FIG. 1 is a circuit diagram of a pixel circuit in the related art.
Figure 2:
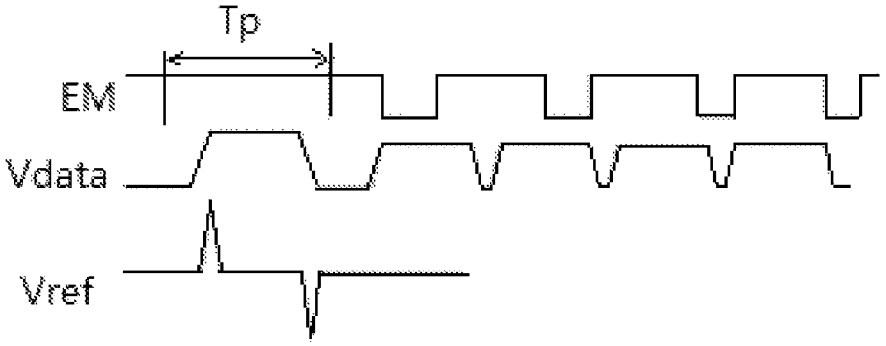
FIG. 2 is a timing diagram of a light-emission control signal, a data voltage $V_{data}$, and a reference voltage $V_{ref}$ outputted from a light-emission control line EM of the pixel circuit shown in FIG. 1.

FIG. 1 is a circuit diagram of a normally black (NB) pixel circuit in the related art, and FIG. 2 is a timing diagram of a data voltage $V_{data}$, a reference voltage $V_{ref}$, and a light-emission control signal that is outputted by the light-emission control line EM of the pixel circuit shown in FIG. 1. As shown in FIG. 2, in a case that the data voltage $V_{data}$ on the data line is hopped from a normal data signal to a positive power supply voltage AVDD during a preparation period Tp, the hop of the data voltage causes the coupling of the reference voltage $V_{ref}$, resulting in a hop of the reference voltage $V_{ref}$. During the display period, the data voltage $V_{data}$ is hopped from AVDD to the normal data signal, causing the coupling of the reference voltage $V_{ref}$, and a hop of the reference voltage $V_{ref}$ occurring. In the NB (normally black) pixel circuit, when $V_{ref}$ changes, a difference is caused in the brightness. In each frame signal, $V_{ref}$ is charged at the turn-on time point of the light-emission control line EM. Therefore, when a pulse width modulation signal (PWM signal, that is, a light-emission control signal outputted by the EM in FIG. 1 that has alternated high level and low level is the PWM signal) is turned on, the hop of the reference voltage $V_{ref}$ may cause a difference in brightness according to the pulse signal of the light-emission control signal outputted by the EM. Meanwhile, the brightness is superimposed at the same time point of each frame, resulting in occurrence of bright dark lines associated with the emission pulse visually. Through the test, there is about 3% brightness difference between the brightness of the bright dark line area and the normal area, causing visual discomfort.

In FIG. 1, a reference sign EM represents a light-emission control line, a reference sign $V_{ref}$ represents a reference voltage, a reference sign VDD represents a power supply voltage, a reference sign Gate represents a gate line, a reference sign $V_{data}$ represents a data voltage, a reference sign Re(N) represents a reset end, a reference sign Init represents a start signal input end, a reference sign VSS represents a low level, a reference sign T1 represents a first transistor, a reference sign T2 represents a second transistor, a reference sign T3 represents a third transistor, a reference sign T4 represents a fourth transistor, a reference sign T5 represents a fifth transistor, a reference sign T6 represents a sixth transistor, a reference sign T7 represents a seventh transistor, a reference sign C represents a storage capacitor, and a reference sign OLED represents an organic light-emitting diode. A display driving method is provided according to some embodiments of the present disclosure, and the method is applied to a display module. The display module includes a plurality of light-emission control lines and a plurality of pixel circuits arranged in a matrix and corresponding to the plurality of light-emission control lines, and the pixel circuits in the same row are connected to the light-emission control line in the same row, and an turn-on duration of the display module includes a plurality of delay cycles. The display driving method includes: during each delay cycle, controlling a phase of a first light-emission control signal to be delayed by a predetermined duration from a phase of a second light-emission control signal, the predetermined duration corresponding to one of the delay cycles, where the first light-emission control signal is a light-emission control signal outputted by any one of the light-emission control line during an (n+1)-th frame of display time period included in the delay cycle, and the second light-emission control signal is a light-emission control signal outputted by the light-emission control line during an n-th frame of display time period included in the delay cycle; and each of the delay cycles includes N frames of display time periods, N is a positive integer greater than a first predetermined number, and n is a positive integer less than N.

With the display driving method according to the embodiments of the present disclosure, in each delay cycle (each delay cycle includes multiple frames of display time periods), the phase of a light-emission control signal outputted by each light-emission control line in a certain frame of display time period is controlled to be delayed by a predetermined duration from the phase of a light-emission control signal outputted by the corresponding light-emission control line in the previous frame of display time period. The value of the predetermined duration may be different with respect to different delay cycles. In this way, phases of the light-emission control signals outputted by the light-emission control line may be controlled to be shifted successively from left to right in the delay cycle, the influence of the coupling of the reference voltage Vref on the brightness difference is subdivided, thereby visually reducing the adverse effect of the brightness difference, and visually improving the bright dark line phenomenon.

In actual operation, the predetermined duration may be M times as long as a turn-on duration of a row of gate line included in the display module, and M is a positive integer less than a second predetermined number.

For example, the predetermined time may be M times as long as the turn-on duration of one row of gate line. For example, M may be equal to 1, which is not limited herein. Since the turn-on duration of one row of gate line is short, the predetermined period may be M times the turn-on duration of one row of gate line in actual operation, M is less than a second predetermined number, and the second predetermined number may be, for example, 4, which is not limited herein.

Optionally, the display driving method may further include: controlling a phase of a light-emission control signal outputted by each of the light-emission control lines in the (a+1)-th delay cycle to be the same as a phase of a light-emission control signal outputted by the corresponding light-emission control line in the a-th delay cycle, where a is a positive integer. In an optional case, the light-emission control signals outputted by the light-emission control line in different delay cycles are the same, so as to avoid resetting the light-emission control signals outputted by the respective light-emission control lines in each delay cycle, and simplifying operations.

For example, the display driving method according to an embodiment of the present disclosure may further include: controlling the light-emission control signal outputted by the light-emission control line to be a pulse width modulation signal during each frame of display time period. In display, the light-emission control signal may be a pulse width modulation signal (PWM).

Figure 3:
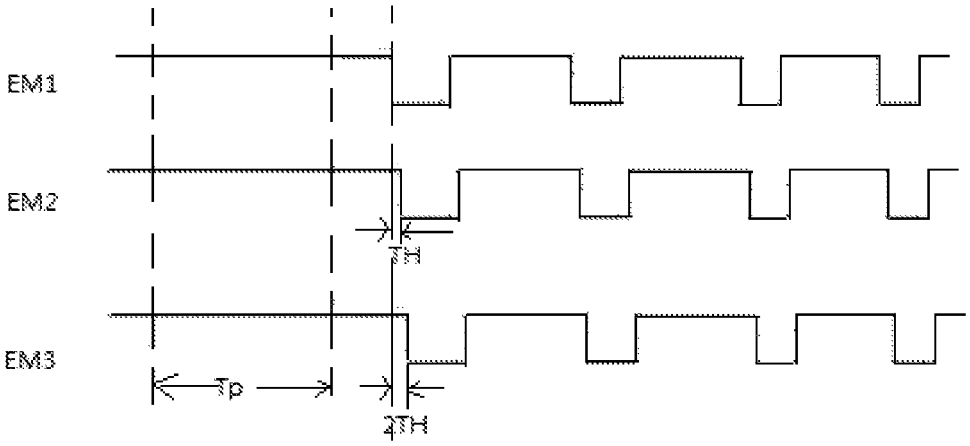
FIG. 3 is a timing diagram of light-emission control signals in a display driving method according to some embodiments of the present disclosure.

In actual operation, a preparation period may be provided between any adjacent frames of the display time periods. FIG. 3 is a timing diagram of light-emission control signals in a display driving method according to some embodiments of the present disclosure, for example, the preparation period in FIG. 3 is Tp. The display driving method may further include: controlling data lines included in the display module to output a direct-current voltage during the preparation period.

The display driving method of the present disclosure is illustrated in conjunction with some embodiments of the present disclosure below.

In some embodiments of the display driving method of the present disclosure, the turn-on duration of the display module may include a plurality of delay cycles (the delay cycle may include N frames of display time periods, and N is equal to 20 in the display driving method according to the embodiments of the present disclosure). The display driving method may include: controlling a phase of a second frame light-emission control signal EM2 to be delayed by TH from a phase of a first frame light-emission control signal EM1 during a first delay cycle; controlling a phase of a third frame light-emission control signal EM3 to be delayed by 2 TH from the phase of the first frame light-emission control signal EM1 and be delayed by TH from the phase of the second frame light-emission control signal EM2; by analogy, controlling a phase of a twentieth frame light-emission control signal (not shown in FIG. 3) to be delayed by 19 TH from the phase of the first frame light-emission control signal EM1, be delayed by 18 TH from the phase of the second frame light-emission control signal EM2 and be delayed by 17 TH from the phase of the third frame light-emission control signal EM3, where TH is equal to the turn-on duration of a row of gate line.

In this example, a reference sign EM1 represents a light-emission control signal on a certain light-emission control line during a first frame of display time period included in the first delay cycle, a reference sign EM2 represents a light-emission control signal on the light-emission control line during a second frame of display time period included in the first delay cycle, a reference sign EM3 represents a light-emission control signal on the light-emission control line during a third frame of display time period included in the first delay cycle, and the twentieth frame light-emission control signal represents a light-emission control signal on the light-emission control line during a twentieth frame of display time period included in the first delay cycle.

In FIG. 3, a reference sign Tp may represent a preparation period between the first delay cycle and the second delay cycle, and the portion on the right of the preparation period Tp may represent the display time periods of the second delay cycle in the turn-on duration of the display module. In the first frame of display time period included in the second delay cycle, the light-emission control signal on the corresponding light-emission control line is the same as EM1. In the second frame of display time period included in the second delay cycle, the light-emission control signal on the light-emission control line is the same as EM2. In the third frame of display time period included in the second delay cycle, the light-emission control signal on the corresponding light-emission control line is the same as EM3. By analogy, in the twentieth frame of display time period included in the second delay cycle, the light-emission control signal on the light-emission control line is the same as the twentieth frame light-emission control signal in the first delay cycle described above.

Similarly, in the second delay cycle, a phase of the light-emission control signal EM2 is delayed by TH from a phase of the light-emission control signal EM1, a phase of the light-emission control signal EM3 is delayed by 2 TH from the phase of the light-emission control signal EM1, and a phase of the light-emission control signal EM3 is delayed by TH from the phase of the light-emission control signal EM2. By analogy, a phase of the twentieth frame light-emission control signal is delayed by 19 TH from the phase of the light-emission control signal EM1, delayed by 18 TH from the phase of the light-emission control signal EM2, and delayed by 17 TH from the phase of the light-emission control signal EM3.

In some embodiments of the display driving method of the present disclosure, the value of the predetermined duration may be different for different delay cycles, that is, a phase of a light-emission control signal in a certain frame of display time period is delayed by different periods of time in different delay cycles from an immediately previous frame of display time period to the frame of display time period. For example, the value of TH in the first delay cycle may be different from the value of TH in the second delay cycle.

It should be noted that the turn-on duration of the display module may include a plurality of delay cycles and preparation periods between the delay cycles, and the driving principles and effects of other delay cycles and the preparation periods are the same as these of the first delay cycle, the second delay cycle and the preparation period Tp therebetween, which are not repeated herein any more.

According to some embodiments of the display driving method shown in FIG. 3 of the present disclosure, a shift register is used in an integrated circuit (IC) to shift a light-emitting position of the light-emission control signal downward by 1 TH per frame, avoiding overlapping of brightness differences. In some embodiments of the display driving method shown in FIG. 3 of the present disclosure, the respective light-emission control signals on light-emission control lines may be successively shifted to the right by 1 TH in each frame of display time period in each delay cycle, and the influence of the coupling of the reference voltage on the brightness difference is subdivided. In some embodiments of the display driving method shown in FIG. 3 of the present disclosure, 3% brightness difference is subdivided into 20 parts so that the brightness difference is adjusted from 3% to 0.05%, thereby visually improving bright dark line phenomenon. A display driving device is further provided according to some embodiments of the present disclosure, which is applied to a display module. The display module includes a plurality of light-emission control lines and a plurality of pixel circuits arranged in a matrix and corresponding to the plurality of light-emission control lines, the pixel circuits in a same row are connected to the light-emission control line in the same row, and an turn-on duration of the display module includes a plurality of delay cycles. The display driving device includes: a light-emission control signal controlling circuit, which are connected to the plurality of light-emission control lines, and are configured to control, during each of the delay cycles, a phase of a first light-emission control signal to be delayed by a predetermined duration from a phase of a second light-emission control signal, the predetermined duration corresponding to the delay cycle, where the first light-emission control signal is a light-emission control signal outputted by any one of the light-emission control lines during an (n+1)-th frame of display time period included in the delay cycle, and the second light-emission control signal is a light-emission control signal outputted by the corresponding light-emission control line during an n-th frame of display time period included in the delay cycle; and each of the delay cycles include N frames of display time periods, N is a positive integer greater than a first predetermined number, and n is a positive integer less than N.

With the display driving device according to the embodiments of the present disclosure, in each delay cycle (each delay cycle includes multiple frames of display time periods), the phase of a light-emission control signal outputted by each light-emission control line in a certain frame of display time period is controlled to be delayed by a predetermined duration from the phase of a light-emission control signal outputted by the corresponding light-emission control line in the previous frame of display time period. The values of the predetermined durations may be different with respect to different delay cycles. In this way, phases of the light-emission control signals outputted by the light-emission control line may be controlled to be shifted successively from left to right in the delay cycle, and the influence of the coupling of the reference voltage $V_{ref}$ on the brightness difference is subdivided, thereby visually reducing the adverse effect of the brightness difference, and visually improving the bright dark line phenomenon.

Figure 4:
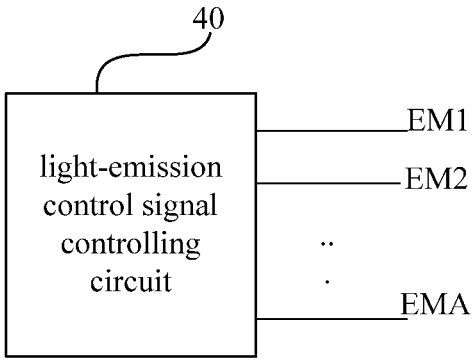
FIG. 4 is a structural block diagram of a display driving device according to some embodiments of the present disclosure.

FIG. 4 is a structural block diagram of a display driving device according to some embodiments of the present disclosure. As shown in FIG. 4, the display driving device according to the embodiments of the present disclosure includes a light-emission control signal controlling circuit 40, and the light-emission control signal controlling circuit 40 is connected to the plurality of light-emission control lines included in the display module.

In FIG. 4, the first row of the light-emission control lines may be labeled as EM1, the second row of the light-emission control lines may be labeled as EM2, the A-th row of the light-emission control lines may be labeled as EMA, and A is an integer greater than 2.

For example, the predetermined duration may be M times the turn-on duration of a row of gate line included in the display module, and M is a positive integer less than a second predetermined number.

For example, the light-emission control signal controlling circuit may further be configured to control a light-emission control signal outputted by each of the light-emission control lines in the (a+1)-th delay cycle to be the same as a light-emission control signal outputted by the corresponding light-emission control line in the a-th delay cycle, a being a positive integer.

For example, the light-emission control signal controlling circuit may be further configured to control the light-emission control signal outputted by each of the light-emission control lines to be a pulse width modulation signal during each frame of display time period.

For example, a preparation period may be provided between any adjacent frames of display time periods, and the display driving device further includes: a source electrode driving circuit, configured to control data lines included in the display module to output a direct-current voltage during the preparation period.

A display module is further provided according to some embodiments of the present disclosure, which includes the display driving device described above.

The forgoing descriptions are only the optional embodiments of the present disclosure. It should be noted that numerous improvements and modifications can further be made by those skilled in the art without being departing from the principle of the present disclosure, and those improvements and modifications shall fall within the protection scope of the present disclosure.

What is claimed is:

1. A display driving method, applied to a display module, wherein the display module comprises a plurality of light-emission control lines and a plurality of pixel circuits arranged in an array and corresponding to the plurality of light-emission control lines, and the pixel circuits in one row are connected to one of the light-emission control lines in the same row, wherein a turn-on duration of the display module comprises a plurality of delay cycles, and the display driving method comprising: during each of the delay cycles, controlling a phase of a first light-emission control signal to be delayed by a predetermined duration from a phase of a second light-emission control signal, the predetermined duration corresponding to the delay cycle, wherein the first light-emission control signal is a light-emission control signal outputted by each of the light-emission control lines during an (n+1)-th frame of display time period comprised in the delay cycle, and the second light-emission control signal is a light-emission control signal outputted by the corresponding light-emission control line during an n-th frame of display time period comprised in the delay cycle; and wherein each of the delay cycles comprises N frames of display time periods, N is a positive integer greater than a first predetermined number, and n is a positive integer less than N.

2. The method according to claim 1, wherein the predetermined duration is M times as long as a turn-on duration of a row of gate line comprised in the display module, and M is a positive integer less than a second predetermined number.

3. The method according to claim 2, further comprising: controlling a phase of a light-emission control signal outputted by each of the light-emission control lines in the (a+1)-th delay cycle of the plurality of delay cycles to be the same as a phase of a light-emission control signal outputted by the each of the light-emission control lines in the a-th delay cycle of the plurality of delay cycles, a being a positive integer.

4. The method according to claim 2, further comprising: controlling the light-emission control signal outputted by each of the light-emission control lines to be a pulse width modulation signal during each frame of display time period.

5. The method according to claim 1, further comprising: controlling a phase of a light-emission control signal outputted by each of the light-emission control lines in the (a+1)-th delay cycle of the plurality of delay cycles to be the same as a phase of a light-emission control signal outputted by the each of the light-emission control lines in the a-th delay cycle of the plurality of delay cycles, a being a positive integer.

6. The method according to claim 1, further comprising: controlling the light-emission control signal outputted by each of the light-emission control lines to be a pulse width modulation signal during each frame of display time period.

7. The method according to claim 6, wherein a preparation time period is provided between any adjacent frames of display time periods, and the display driving method further comprises:

controlling data lines comprised in the display module to output a direct-current voltage during the preparation period.

8. The method according to claim 1, wherein the light-emission control signal outputted by each of the light-emission control lines is used to control the pixel circuits in a same row to emit light simultaneously.

9. The method according to claim 1, wherein the first light-emission control signal is obtained by shifting the second light-emission control signal.

10. A display driving device, applied to a display module, wherein the display module comprises a plurality of light-emission control lines and a plurality of pixel circuits arranged in an array and corresponding to the plurality of light-emission control lines, and the pixel circuits in one row are connected to one of the light-emission control lines in the same row, wherein a turn-on duration of the display module comprises a plurality of delay cycles, and the display driving device comprises:

a light-emission control signal controlling circuit, connected to the plurality of light-emission control lines, and configured to control, during each of the delay cycles, a phase of a first light-emission control signal to be delayed by a predetermined duration from a phase of a second light-emission control signal, wherein the first light-emission control signal is a light-emission control signal outputted by each of the light-emission control lines during an (n+1)-th frame of display time period comprised in the delay cycle, and the second light-emission control signal is a light-emission control signal outputted by the corresponding light-emission control line during an n-th frame of display time period comprised in the delay cycle; and wherein each of the delay cycles comprises N frames of display time periods, N is a positive integer greater than a first predetermined number, and n is a positive integer less than N.

11. The device according to claim 10, wherein the predetermined duration is M times as long as a turn-on duration of a row of gate line comprised in the display module, and M is a positive integer less than a second predetermined number.

12. The device according to claim 11, wherein the light-emission control signal controlling circuit is further configured to control a phase of a light-emission control signal outputted by each of the light-emission control lines in the (a+1)-th delay cycle of the plurality of delay cycles to be the same as a phase of a light-emission control signal outputted by the each of the light-emission control lines in the a-th delay cycle of the plurality of delay cycles, a being a positive integer.

13. The device according to claim 11, wherein the light-emission control signal controlling circuit is further configured to control the light-emission control signal outputted by each of the light-emission control lines to be a pulse width modulation signal during each frame of display time period.

14. The device according to claim 10, wherein the light-emission control signal controlling circuit is further configured to control a phase of a light-emission control signal outputted by each of the light-emission control lines in the (a+1)-th delay cycle of the plurality of delay cycles to be the same as a phase of a light-emission control signal outputted by the each of the light-emission control lines in the a-th delay cycle of the plurality of delay cycles, a being a positive integer.

15. The device according to claim 10, wherein the light-emission control signal controlling circuit is further configured to control the light-emission control signal outputted by each of the light-emission control lines to be a pulse width modulation signal during each frame of display time period.

16. The device according to claim 15, wherein a preparation period is provided between any adjacent frames of display time periods, and the display driving device further comprises:

a source electrode driving circuit, configured to control data lines comprised in the display module to output a direct-current voltage during the preparation period.

17. A display module, comprising the display driving device according to claim 10.

18. The device according to claim 10, wherein the light-emission control signal outputted by each of the light-emission control lines is used to control the pixel circuits in a same row to emit light simultaneously.

* * * * *